US005389938A

United States Patent [19]

Harrison

[11] Patent Number: 5,389,938

[45] Date of Patent: Feb. 14, 1995

[54] RETRACTABLE ANTENNA ASSEMBLY WITH RETRACTION SHORT CIRCUITING

[75] Inventor: Peter Harrison, Ascot, England

[73] Assignee: Nokia Mobile Phones (U.K.) Limited, Surrey, United Kingdom

[21] Appl. No.: 80,389

[22] Filed: Jun. 21, 1993

Related U.S. Application Data

[63] Continuation of Ser. No. 912,543, Jul. 13, 1992, abandoned.

[30] Foreign Application Priority Data

Jul. 13, 1991 [GB] United Kingdom ..... 9115136

[51] Int. Cl.[6] ..... H01Q 1/24

[52] U.S. Cl. ..... 343/702; 343/900; 343/901

[58] Field of Search ..... 343/702, 715, 900, 901, 343/725, 729, 846, 906; H01Q 1/24

[56] References Cited

U.S. PATENT DOCUMENTS

| | | | |
|---|---|---|---|
| 3,087,117 | 4/1963 | Mitchell | 325/118 |
| 4,525,718 | 6/1985 | Imazeki et al. | 343/702 |
| 4,920,352 | 4/1990 | Martensson et al. | 343/702 |
| 4,989,012 | 1/1991 | Martensson et al. | 343/702 |
| 5,072,230 | 12/1991 | Taniyoshi et al. | 343/715 |

FOREIGN PATENT DOCUMENTS

| | | | |
|---|---|---|---|
| 0359361A1 | 6/1989 | European Pat. Off. . | |
| 0359361 | 3/1990 | European Pat. Off. | H01Q 1/10 |
| 63-69302 | 3/1988 | Japan | 343/702 |
| 828213 | 2/1960 | United Kingdom . | |
| 1507076 | 4/1978 | United Kingdom . | |
| 2185634A | 7/1987 | United Kingdom . | |
| 2185635A | 7/1987 | United Kingdom . | |
| 2219911A | 12/1989 | United Kingdom . | |
| 2237688 | 5/1991 | United Kingdom | H01Q 1/10 |

*Primary Examiner*—Donald Hajec
*Assistant Examiner*—Hoanganh T. Le
*Attorney, Agent, or Firm*—Perman & Green

[57] ABSTRACT

An antenna assembly comprises an elongate radiating antenna (11) movable between a retracted position and an extended position. A pair of concentric conductors (9,10) provide coaxial feed to the antenna (11). In the retracted position the antenna 11 in conjunction with the coaxial feed (9,10) constitute a quarter wavelength transmission line which is short-circuited by a conductive flange (15) on the antenna. A short-circuited quarter wavelength transmission line electrically appears as an open circuit at the feed point. The antenna is thus automatically decoupled when it is moved to the retracted position without the need for additional switching or screening elements.

17 Claims, 2 Drawing Sheets

RETRACTABLE ANTENNA ASSEMBLY WITH RETRACTION SHORT CIRCUITING

This is a continuation of application Ser. No. 07/912/543, filed on Jul. 13, 1992, now abandoned.

This invention relates to an antenna assembly comprising a retractable antenna which may be applied, for example, to a portable radio and, in particular a hand portable radio telephone.

BACKGROUND OF THE INVENTION

A radio intended for two-way communication generally operates with either an external fixed rod or retractable antenna, or with an internal antenna. The fixed rod type of antenna has a predetermined length. Whilst such antennas can be relatively short, they are not conductive to a compact design nor are they particularly suitable for a radio intended to be carried in a pocket or other receptacle offering restricted space. On the other hand, retractable antennas are convenient for this purpose because they can be folded away when the radio is not in use. Retractable antennas are commonly of the telescopic tube type, although retractable fixed length antennas are also known.

Some known portable radios such as that disclosed in U.S. Pat. No. 3,087,117 have two antennas, i.e. an internal element together with a retractable element, and are also equipped with means for automatically switching between the two elements according to the physical position of the retractable element. Hence the retractable antenna is operable in the extended position, while the internal antenna element becomes operable when the retractable element is in the retracted position.

An important consideration with a dual antenna system is that both antennas should provide efficient operation under different conditions as appropriate. For example, while the external antenna element may provide better sensitivity and range performance during normal operation, the less efficient internal antenna must provide satisfactory performance during stand-by operation.

U.S. Pat. No. 4,868,576 discloses an antenna for a portable cellular telephone comprising a helical coil at the base of a retractable elongate radiating element. The retractable element, which extends through the helical coil, has non-conductive portions at its two ends whereby in the extended position the elongate element is capacitively coupled to the helical coil, and in the retracted position the elongate element is substantially decoupled therefrom. The helical coil is fixedly mounted on the housing of the radio transceiver.

British patent GB-A-844,968 discloses an arrangement for connecting an external antenna to a radio receiver having a single existing, internal antenna intended for use in a vehicle. A housing is provided into which the radio is slidably mounted. A jack plug connected to the external antenna is fixedly mounted on the rear wall of the housing so that when the radio is fully inserted into the housing the jack plug mates with an antenna socket provided in the back of the radio apparatus. The housing acts to screen the internal antenna and thereby render it inoperative when the jack plug and hence the external antenna are connected. This arrangement requires the radio to be almost completely encased within the housing, so making the radio relatively inaccessible when connected to the external antenna. Also, since the internal antenna remains physically and electrically connected to the radio circuits, this arrangement is not suitable for a radio intended for transmission as well as reception.

EP-A-0,343,848 discloses an antenna assembly for enabling an external antenna to be connected to a portable radio in place of an existing antenna. An adapter is slidably located in a passageway, which may be part of an integral moulding of the radio casing. The existing antenna is slidably located in the same passageway such that it is displaced and so disconnected from the radio when the adapter is fitted. Alternatively, the radio has an internal existing antenna which is switched out when the adapter makes an external antenna connection.

SUMMARY OF THE INVENTION

According to the present invention there is provided an antenna assembly comprising a radiating element movable between a retracted position and an extended position, and a pair of substantially concentric conductors providing coaxial feed means to said radiating element when the radiating element is in the extended position, wherein in the retracted position the radiating element in conjunction with the coaxial feed means constitute a short-circuited transmission line having an effective electrical length of a quarter wavelength.

An antenna assembly in accordance with the invention has the advantage that the radiating element is automatically rendered inactive as a radiator when it is moved to the retracted position, without the need for switching or screening means.

The radiating element is rendered inoperable as an antenna in the retracted position by virtue of it forming part of a short-circuited quarter wavelength transmission line in conjunction with the coaxial feed means. A short-circuited quarter wavelength transmission line electrically looks like an open circuit at the feedpoint and hence the radiating element effectively disappears when it is retracted.

The radiating element, which suitably is elongate, may be slidably mounted within and electrically connected to the inner conductor of the concentric pair.

In a preferred embodiment contact means, e.g. in the form of a flange extending transversely to the elongate element and provided at the outer end thereof, are responsible for electrically coupling (short-circuiting) the inner conductor of the concentric pair of conductors to the outer conductor of the concentric pair when the elongate radiating element is in the retracted position.

In a particular embodiment a pair of concentric conductors additionally provide coaxial feed means to an external antenna connection. This provides the facility for an external antenna to be connected particularly when the retractable radiating element has been retracted.

Preferably a common pair of concentric conductors provide the coaxial feed means both to said radiating element and to the external antenna connection.

The coaxial feed means to the external antenna connection suitably constitute a further quarter wavelength transmission line. Switching means may also be included which normally make an electrical connection between the inner and outer conductors of the further coaxial transmission line, i.e. in the absence of an external antenna. On the other hand the switching means are adapted to break the electrical connection between the inner and outer conductors of the further coaxial transmission line when an external antenna is connected. Thus in the absence of an external antenna the further quarter wavelength transmission line is short circuited and therefore presents an open circuit at the feed point so that the further transmission line does not absorb any power. However, when an external antenna is connected (and the movable radiating element is retracted and so itself does not absorb any power) all the RF power applied to the coaxial feed means will be conveyed to the external antenna connection.

In an alternative embodiment an additional fixed radiating element may also be provided and in this case the movable radiating element may be retractable to a partially retracted position whereat the movable radiating element constitutes at least part of a coaxial feed means to the fixed radiating element.

BRIEF DESCRIPTION OF THE DRAWINGS

Embodiments of the invention will now be described, by way of example, with reference to the accompanying drawings, in which.

Figure 1:
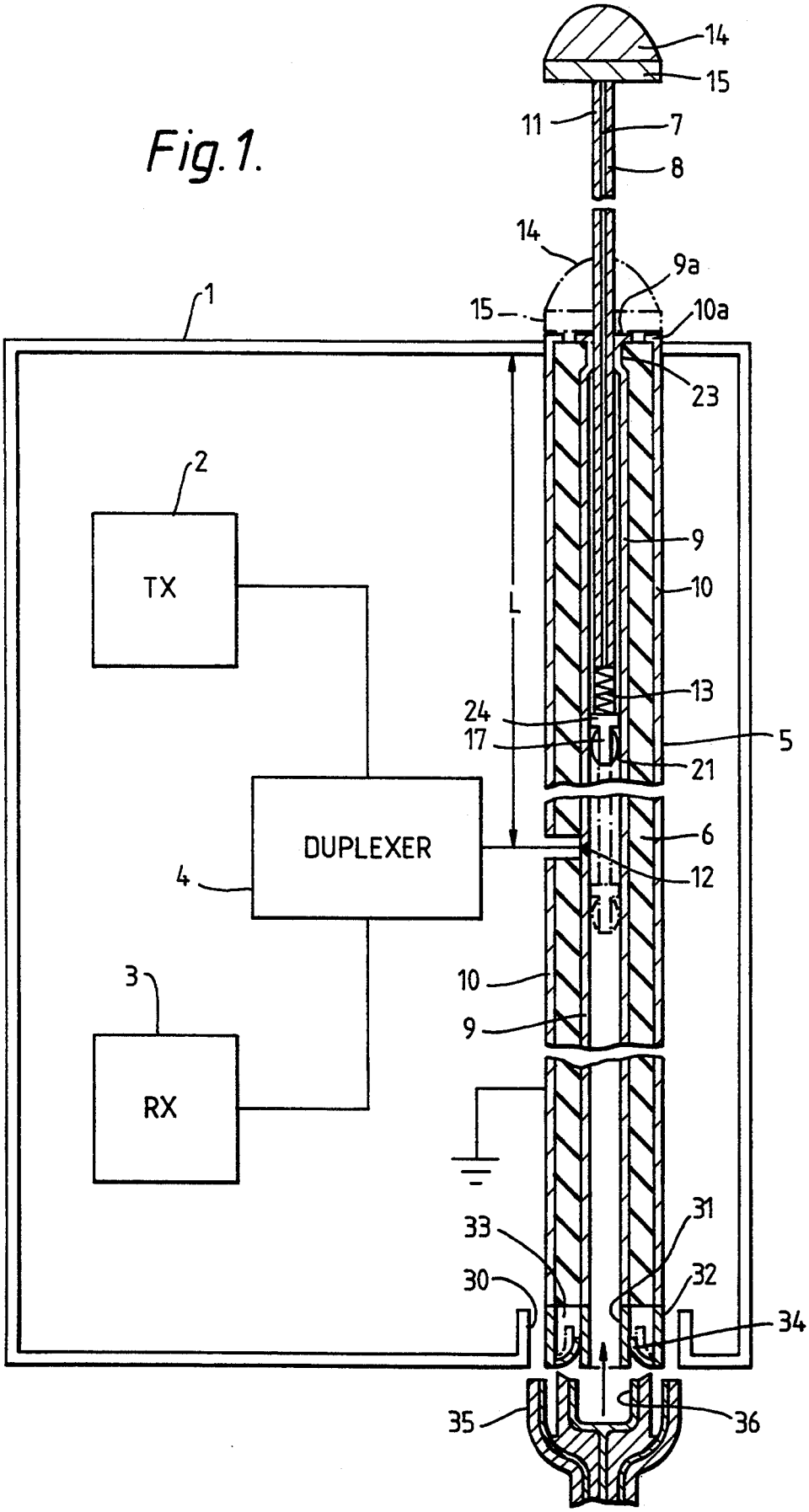
FIG. 1 is a schematic cross-section of a portable cellular radio telephone incorporating an antenna assembly in accordance with the present invention, showing the antenna in a partially extended position.

It is noted that for the sake of clarity the Figures are not drawn to scale.

DETAILED DESCRIPTION OF THE INVENTION

The portable cellular radio telephone shown in the Figures comprises a housing 1 enclosing a conventional transmitter 2 and receiver 3 coupled respectively via a duplexer 4 at a feed point 12 to the inner conductor 9 of the coaxial feed to the antenna assembly. The coaxial feed is discussed in more detail below.

The housing 1 also encloses all the other features conventionally found in a portable cellular telephone. Since these aspects are not directly relevant to the instant invention no further details will be given here.

The antenna assembly, provided adjacent the top face of the radio housing 1, comprises a support 5 in the form of a dielectric cylindrical tube 6. The dielectric material of the tube 6 may, for example, be polytetrafluoroethylene (PTFE) or polyethylene.

The bore of the dielectric tube 6 is provided with a conductive coating 9, for example of nickel plated copper. The conductor 9 has a portion 9 extending on to the top face of the dielectric tube 6. A conductive coating 10, for example of copper is also provided on the outer face of the tube 6. The outer conductor 10 has a portion 10*a* extending onto the top face of the dielectric tube 6. The inner and outer conductive coatings 9 and 10 are electrically isolated from each other. The outer conductor is electrically connected to ground potential, e.g. via ground metallization provided on the internal faces of the housing 1. Hence, the support 5 constitutes a coaxial transmission line for feeding the antenna element. The characteristic impedance $Z_o$ of this transmission line is given by the equation $$Z_o = \frac{60}{\sqrt{(\epsilon_r)}} \ln (d_o/ d_i)$$

where $\epsilon_r$ is the relative permittivity of the dielectric material of tube 6, $d_o$ is the diameter of the outer conductor of the coaxial feed, and $d_i$ is the diameter of the inner conductor of the coaxial pair. Hence the respective diameters of the inner and outer conductors may be chosen to give the desired impedance.

An elongate radiating antenna element 11 comprises a central conductor 7 which may be a solid rod antenna or, alternatively, may be in the form of a close-wound coil which not only enhances flexibility of the elongate element and so reduces the risk of breakage, but also reduces the physical length of the antenna. The coil may be made of silver plated beryllium-copper wire. The elongate antenna element 11 may be chosen to have an equivalent electrical length, for example, of a quarter-wavelength or three-eights wavelength. The conducting portion 7 of the elongate element 11 is enclosed within an insulating sleeve 8 made for example of a flexible plastics material. At the base of the elongate antenna element there is provided an impedance matching inductor 13 having one end connected to the conductor 7 of the elongate antenna element 11 and the other end connected to an electrically conductive end portion 17 which is in electrical contact with the inner conductor 9 of the dielectric tube 6 (see FIG. 3). The inductor 13 is present within the insulating sleeve 8. A radially biassed phosphor bronze spring 21 surrounding the end portion 17 bears against the inner conductor 9 of the support 5 for optimal electrical contact therewith.

The elongate antenna element 11 is slidably mounted in the bore of the dielectric tube 6 and the conductive spring 21 remains in electrical contact with the inner conductor 9 at all times.

A conductive disc-shaped flange 15 is provided at the end of the elongate antenna element 11 remote from the support 5. The flange 15 is electrically connected to the conducting portion 7 of the elongate element 11. A tab 14, made for example of an insulating material, is provided on the outward face of flange 15. The tab 15, which may be of any suitable shape, provides a convenient feature for the user to grip when extending or retracting the antenna.

When the elongate antenna element 11 is extended the electrically conductive end portion 17, which is coupled to the lower end of the impedance matching inductor, continues to make electrical contact via the conductive spring 21 with the inner conductor 9 of the support 5. The support 5 thus acts as a coaxial feed to the elongate radiating element 11. As mentioned previously, the inner conductor 9 on the dielectric tube 6 is coupled by means of a connection at feed point 12 to the radio transmitter 2 and receiver 3 via the duplexer 4.

The dielectric tube has a projection 23 extending into the bore to provide a narrower diameter portion at the top end thereof. The elongate antenna element is provided with an outwardly extending flange 24 between the inductor 13 and the end portion 17. The flange 24 on the antenna element 11 abuts the projection 23 in the support 5 when the antenna is fully extended and this acts as a stop to prevent further withdrawal of the antenna.

In the retracted position, shown by the broken line in FIG. 1, the flange 15 at the outer end of the elongate antenna element 11 bridges the conductive portions 9*a* and 10*a* on the top face of the dielectric tubes and hence forms a short-circuit between the inner conductor 9 and the outer conductor 10 of the coaxial feed means. The feed point 12 to the coaxial transmission line constituted by the support 5 is selected so that the length L of the transmission line between the feed point 12 and the upper face of the dielectric type 6 adjacent the antenna flange 15 is electrically equivalent to a quarter wavelength. Hence, in the retracted position, the radiating element 11 in conjunction with the coaxial feed 9,10 thereto constitute a short-circuited quarter wavelength transmission line which effectively looks like an open circuit from the feed point. Hence the retractable antenna is automatically rendered inoperable as a radiating means when it is in the retracted position.

As can be seen in FIG. 1, the support 5 also extends from the feed point 12 towards the base of the radio housing 1 and terminates in an external antenna connection socket 30.

In the vicinity of the socket 30 the support 5 includes a pair of concentric conductive cylinders 31,32 spaced apart by an air gap 33. The inner conductive cylinder 31 is electrically connected to the inner conductor 9 on the dielectric tube 5, and the outer conductive cylinder 32 is electrically connected to the outer conductor 10 of the dielectric tube 6.

A conductive contact spring 34 extends from the outer end of the outer cylinder 32 and is ordinarily biassed into electrical contact with the inner conductive cylinder 31.

The overall length of the coaxial transmission line constituted by the part of the coaxial support 5 between the feed point 12 and the socket 30, together with the concentric cylinders 31, 32 is chosen to be equivalent electrically to a quarter wavelength. Since this quarter wavelength transmission line in the absence of an external antenna is short circuited by virtue of the spring contact 34, it appears as an open circuit at the feed point 12 and hence all the power input at feed point 12 will be available to the elongate antenna element 11 when it is extended.

When an external antenna is connected a coaxial plug 35 coupled to the external antenna is inserted in the direction of the arrows into the socket 30 in the base of the radio housing. The central conductor 36 of the coaxial plug engages the central conductive cylinder 31 coupled to the internal conductor 9 on support 5, and also displaces the spring contact 34 into the position shown by the broken line thereby breaking the electrical connection between the inner and outer conductors 31, 32 of the transmission line. The power input at feed point 12 will therefore now all be conveyed to the external antenna via the external antenna connection when the elongate antenna is retracted.

Figure 2:
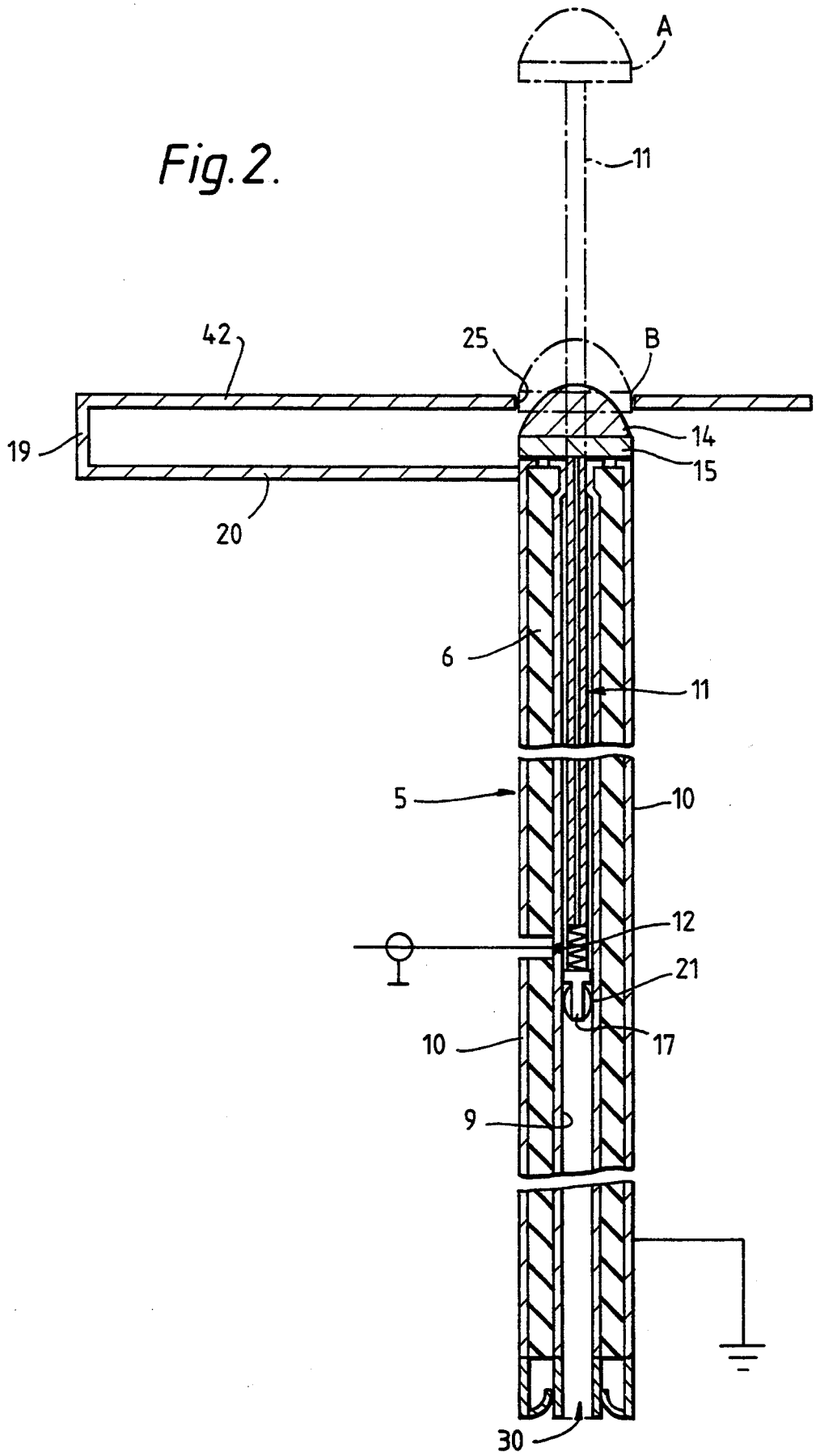
FIG. 2 is a schematic cross-section of an alternative antenna assembly in accordance with the invention.

FIG. 2 illustrates a modified embodiment of an antenna assembly in accordance with the present invention. In this embodiment an additional fixed antenna is also provided in the form of a so-called planar inverted F (PIF) antenna comprising a substantially flat plate-like radiating element 42 coupled via an upstanding conductive portion 19 to a further substantially planar conductive member 20 forming a ground plane spaced apart and parallel to the plate-like radiating element 42. The ground plane conductor 20 extends as far as the support 5 and is in electrical contact with the outer grounded conductor 10 thereon.

The plate-like radiating element 42 comprises a circular aperture 25 disposed directly above the support 5, through which aperture the elongate antenna 11 extends. The size and shape of the aperture 25 are complementary to the flange 15.

When the elongate antenna 11 is fully extended, as represented by the broken line labelled A in FIG. 2, the elongate element is operative as a radiating element as already described in relation to the previous embodiment. Similarly, when the elongate antenna is fully retracted, as represented by the solid line in FIG. 2, the elongate element 11 is rendered inoperable as a radiator as described in relation to the previous embodiment. However, in the partially retracted position, as represented by the broken line labelled B in FIG. 2, the flange 15 at the outer end of the elongate element 11 fits into the aperture 25 of the plate like antenna 12 in such manner as to make intimate electrical connection therewith. The conductive end portion 17 of the elongate element 11 remains in electrical contact via conductive spring 21 with the inner conductor 9. The elongate antenna element thus essentially becomes a part of the coaxial feed coupled directly to the plate antenna 12. Since the elongate antenna element 11 is substantially enclosed by conductive material it is itself rendered inactive as a radiator. Hence, the fixed PIF antenna is automatically connected and the elongate antenna element is automatically rendered inoperative simply by moving the elongate antenna element to the partially retracted position. However, when the elongate element is moved to the fully retracted position the plate antenna will also be disconnected and the coaxial feed to antennas 11 and 42 will look like an open circuit at the feed point whereby the input power may be diverted to an external antenna via a connection at the socket 30 exactly as described above in relation to the previous embodiment.

In view of the foregoing description it will be evident to a person skilled in the art that various modifications may be made within the scope of the present invention. For example, instead of being formed primarily of a solid dielectric tube the antenna support may comprise in its entirety a pair of concentric metal cylinders held in spaced relationships by insulating spacers. In this case the dielectric may be air in the gap between the concentric cylinders. Furthermore, it is noted here that neither the dielectric tube and the bore thereof, nor the concentric metal cylinders need be circular in cross-section, but may instead be square, rectangular, oval or indeed any other suitable shape.

I claim:

1. An antenna assembly comprising a radiating element movable between a retracted position and an extended position, a pair of substantially concentric conductors providing coaxial feed means to said radiating element when the radiating element is in the extended position, contact means for electrically connecting an inner conductor of the pair of conductors to an outer conductor of the pair of conductors when the radiating element is in its retracted position, the radiating element, in the retracted position, and the coaxial feed means forming a short-circuited transmission line with the length of the inner conductor from a feed point on the inner conductor through the contact means and through the outer conductor having an effective electrical length of a quarter wavelength, wherein the pair of concentric conductors are connected to an external antenna connection, the pair of concentric conductors are singular members that provide the coaxial feed means both to said radiating element and to said external antenna connection and, the radiating element is slidably mounted within the inner conductor of the pair of conductors.

2. An antenna assembly as claimed in claim 1, wherein the radiating element is elongate.

3. An antenna assembly as claimed in claim 2, wherein the radiating element is electrically connected to the inner conductor of the concentric pair of conductors.

4. An antenna assembly as claimed in claim 3, wherein the radiating element is electrically connected to the inner conductor by contact means provided near another end of the elongate radiating element.

5. An antenna assembly as claimed in claim 3, wherein the contact means at said one end of the elongate radiating element is in the form of a flange extending transversely to the elongate radiating element.

6. An antenna assembly as claimed in claim 1, wherein the pair of conductors connected to the external antenna connection constitute a further quarter wavelength coaxial transmission line.

7. An antenna assembly as claimed in claim 6, including switching means adapted to make an electrical connection between the inner and outer conductors of said further coaxial transmission line in the absence of an external antenna, and to break the electrical connection between the inner and outer conductors of said further coaxial transmission line when an external antenna is connected.

8. An antenna assembly as claimed in claim 1, wherein the contact means is provided at one end of the elongate radiating element.

9. An antenna assembly comprising a radiating element movable between a retracted position and an extended position, a pair of substantially concentric conductors providing coaxial feed means to said radiating element when the radiating element is in the extended position, contact means for electrically connecting an inner conductor of the pair of conductors to an outer conductor of the pair of conductors when the elongate radiating element is in its retracted position, the radiating element, in the retracted position, and coaxial feed means forming a short-circuited transmission line with the length of the inner conductor from a feed point on the inner conductor through the contact means and through the outer conductor having an elective electrical length of a quarter wavelength wherein the pair of concentric conductors are connected to an external antenna connection and are singular members that provide the coaxial feed means both to said radiating element and to said external antenna connection.

10. An antenna assembly as claimed in claim 9, wherein the radiating element is elongate.

11. An antenna assembly as claimed in claim 10, wherein the radiating element is slidably mounted within the inner conductor of the concentric pair of conductors.

12. An antenna assembly as claimed in claim 10, wherein the radiating element is electrically connected to the inner conductor of the concentric pair of conductors.

13. An antenna assembly as claimed in claim 12, wherein the radiating element is electrically connected to the inner conductor by contact means provided near the other end of the elongate radiating element.

14. An antenna assembly as claimed in claim 12, wherein the contact means at said one end of the elongate radiating element is in the form of a flange extending transversely to the elongate radiating element.

15. An antenna assembly as claimed in claim 9, wherein the pair of conductors connected to the external antenna connection constitute a further quarter wavelength coaxial transmission line.

16. An antenna assembly as claimed in claim 15, including switching means adapted to make an electrical connection between the inner and outer conductors of said further coaxial transmission line in the absence of an external antenna, and to break the electrical connection between the inner and outer conductors of said further coaxial transmission line when an external antenna is connected.

17. An antenna assembly comprising a radiating element movable between a retracted position and an extended position, a pair of substantially concentric conductors providing coaxial feed means to said radiating element when the radiating element is in the extended position, contact means for electrically connecting an inner conductor of the pair of conductors to an outer conductor of the pair of conductors when the elongate radiating element, in the retracted position, and coaxial feed means forming a short-circuited transmission line with the length of the inner conductor from a feed point on the inner conductor through the contact means and through the outer conductor having an effective electrical length of a quarter wavelength wherein the pair of concentric conductors are connected to an external antenna connection, and constitute a further quarter wavelength coaxial transmission line.

* * * * *